US007028443B2

(12) United States Patent
Bennett et al.

(10) Patent No.: US 7,028,443 B2
(45) Date of Patent: Apr. 18, 2006

(54) WIRE MESH CHAIR

(75) Inventors: Clifford D. Bennett, Rancho Cucamonga, CA (US); Kenneth Lee, Anaheim, CA (US)

(73) Assignee: Dayton Superior Corporation, Dayton, OH (US)

( * ) Notice: Subject to any disclaimer, the term of this patent is extended or adjusted under 35 U.S.C. 154(b) by 24 days.

(21) Appl. No.: 10/614,715

(22) Filed: Jul. 7, 2003

(65) Prior Publication Data

US 2005/0005564 A1 Jan. 13, 2005

(51) Int. Cl.
*E04C 5/16* (2006.01)

(52) U.S. Cl. ..... 52/686; 52/687; 52/689

(58) Field of Classification Search ..... 52/677, 52/686, 687, 689
See application file for complete search history.

(56) References Cited

U.S. PATENT DOCUMENTS

| | | | | |
|---|---|---|---|---|
| 3,693,310 | A | 9/1972 | Middleton | |
| 4,060,954 | A | 12/1977 | Liuzza | |
| 4,835,933 | A | 6/1989 | Yung | |
| 5,107,654 | A | 4/1992 | Leonardis | |
| D334,133 | S | 3/1993 | Hartzheim | |
| 5,729,949 | A | 3/1998 | Hartzheim | |
| D394,200 | S | 5/1998 | Hartzheim | |
| 6,276,108 | B1 * | 8/2001 | Padrun | 52/684 |
| 6,282,860 | B1 | 9/2001 | Ramirez | |
| 6,663,316 | B1 * | 12/2003 | Harris | 404/136 |
| 6,684,594 | B1 * | 2/2004 | Sorkin | 52/685 |
| 6,684,595 | B1 * | 2/2004 | Sorkin | 52/685 |
| 2003/0000170 | A1 * | 1/2003 | Sorkin | 52/677 |

* cited by examiner

*Primary Examiner*—Naoko Slack
(74) *Attorney, Agent, or Firm*—Wood, Herron & Evans, LLP

(57) ABSTRACT

A chair for supporting wire mesh while pouring concrete slabs. The chair has a generally tapered, hollow body with a receiving area for fixedly retaining the wire mesh. The receiving area includes walls extending upwardly between notches, with the walls defining passageways for guiding the mesh into the notches. Detents project inwardly from the tops of the walls to fixedly retain the mesh within the passageways. The body has inner and outer surfaces that are substantially complementary to one another to allow a plurality of chairs to be stacked together. One or more foot members are preferably attached to the lower base portion to provide for secure support of the chair on a variety of surfaces.

21 Claims, 4 Drawing Sheets

WIRE MESH CHAIR

FIELD OF THE INVENTION

The present invention relates generally to chairs and spacers that are used in construction activities for the support of steel reinforcement members, and in particular to stackable chairs that are reliably able to retain welded wire mesh within concrete slabs.

BACKGROUND OF THE INVENTION

Chairs or spacers are commonly used in the construction industry for the support and positioning of steel reinforcement members, such as wire mesh, post-tension cables and/or reinforcement bars ("rebar"), a proper distance above a surface. The bars or cables are usually arranged in rows or grids within an area into which concrete is to be poured. They are held loosely in place while concrete is placed around them. In normal Proper spacing and arrangement of steel reinforcement members in concrete slabs and/or tilt-up panels according to known engineering and architectural specifications impacts the structural strength and integrity of the concrete structure. Such steel reinforcement requires sufficient cover to avoid exposing the steel to the effects of moisture-penetrating corrosion. Once the steel is exposed to the effects of chemical-laden moisture, corrosion starts taking effect.

Known prior art chairs have desirable features which provide the proper support of rebar or post-tension cables safely within a concrete structure. Some chairs also have additional desirable features. For example, U.S. Pat. No. 5,729,949 to Hartzheim discloses a readily stackable chair with a hollow-conical body that minimizes the amount of shipping and storage space required. These chairs have support legs with apertures between them to allow concrete to flow into the hollow interior of the chair. A worker can carry many chairs at one time and place numerous chairs at a construction site without repeated trips to a storage area. U.S. Pat. No. 4,835,933 to Yung, and U.S. Pat. No. 3,693,310 to Middleton both disclose retention means or clips for use in connecting reinforcing members together. Such retention means are designed for use with intersecting or crossing bars, and provide an attractive alternative to the wires which are widely used for tying reinforcing bars together. U.S. Pat. No. 6,282,860 to Ramirez discloses a non-stackable chair for wire mesh which includes pairs of cup shaped members which engage the bars of the wire mesh and may hold the mesh via a retention means.

While the prior art chairs described above may be useful for their respective, particular objectives, the majority are generally intended for support of rebar or post-tensioning cables, which is not always effective for the support of wire mesh. Also, most prior art chairs are not able to be stacked, and therefore require an inordinate amount of space for shipping and storage. Other chairs lack retention means to reliably secure the reinforcement members.

Therefore, a need exists for a chair that is adapted to support wire mesh during pouring of a reinforced concrete structure, which not only reliably secures the wire mesh, but also is stackable for more efficient shipping and storage.

SUMMARY OF THE INVENTION

One objective of the present invention is to provide a chair designed specifically to fixedly retain wire mesh. Another objective of the invention is to provide a wire mesh chair that can be stacked within another chair to provide a more efficient method for packaging, storage, shipment and ease of handling and convenience at the job site. It is a further objective of the present invention to provide a wire mesh chair with a wide base that allows the chair to stand securely. It is also an objective to provide a plastic chair made of durable, non-corrosive materials that is easy to manufacture and easy to use with wire mesh.

Briefly stated, these objectives are accomplished by a tapered wire mesh chair having a hollow body with a receiving area for fixedly retaining the wire mesh. In one embodiment of the invention, the receiving area has a plurality of notches, walls, and detents which work in a cooperative manner to snap-fit or retain the wire mesh within the receiving area. The walls project upwardly between the notches and have generally planar or flat tops which connect to the detents.

In accordance with one aspect of the invention, the receiving area secures and retains the intersecting portions of the wire mesh. The detents extend horizontally inwardly from the upstanding walls in an off-centered fashion. There is an upper opening in the receiving area that permits a crossing section of the wire mesh to enter the chair. The crossing sections of the wire mesh are retained in the passageways by the off-centered detents, and are inserted through the upper opening and over the detents, fitting into the passageways which are defined by adjacent walls.

In accordance with another aspect of the invention, the body of the wire mesh chair may have multiple substantially straight sides and a substantially square cross-section having rounded corners, with an inner surface that is complementary to the outer surface to allow a plurality of chairs to be stacked together, one inside the other, for storage and shipment. The chair may also have an elliptical, oval or hybrid cross-section. The chair preferably has a wide base which is adapted to rest on a flat support surface. The upper opening is defined by the receiving area and a lower opening is defined by the base. The lower opening is preferably larger than the upper opening, and the inner and outer surfaces are preferably substantially complementary to each other.

In another embodiment of the invention, the base has a plurality of separate support legs extending downwardly from the receiving area. Adjacent support legs define apertures or holes between them, which allow poured concrete to pass fluidly through the chair. One or more supporting foot members are preferably attached to the lower base portion to provide for secure support of the chair on a variety of surfaces, including harder surfaces such as a concrete mold or softer surfaces such as graded soil. In one embodiment, the foot member extends horizontally outwardly from each of the legs, and is preferably a singular flattened, disc-like platform that interconnects the legs, forming a solid band of material around the lower opening. Alternatively, each of the legs can be attached to an outwardly extending foot member, such that there are as many foot members as there are legs. In yet another embodiment, the foot members are thin protrusions which extend downwardly from the legs and have a projection extending outwardly therefrom, thereby causing a small, narrow footprint. This embodiment is useful for construction of wire mesh-reinforced tilt-up panels.

In accordance with another aspect of the invention, the receiving area and the base are integrally formed together from a durable, non-corrosive polymeric material. The chairs are easy to manufacture in this fashion, and packaging and storage of the chairs can be done quickly and easily because the chairs are also stackable. These and other aspects of the present invention will be more fully appreciated with respect to the following drawings and detailed description.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
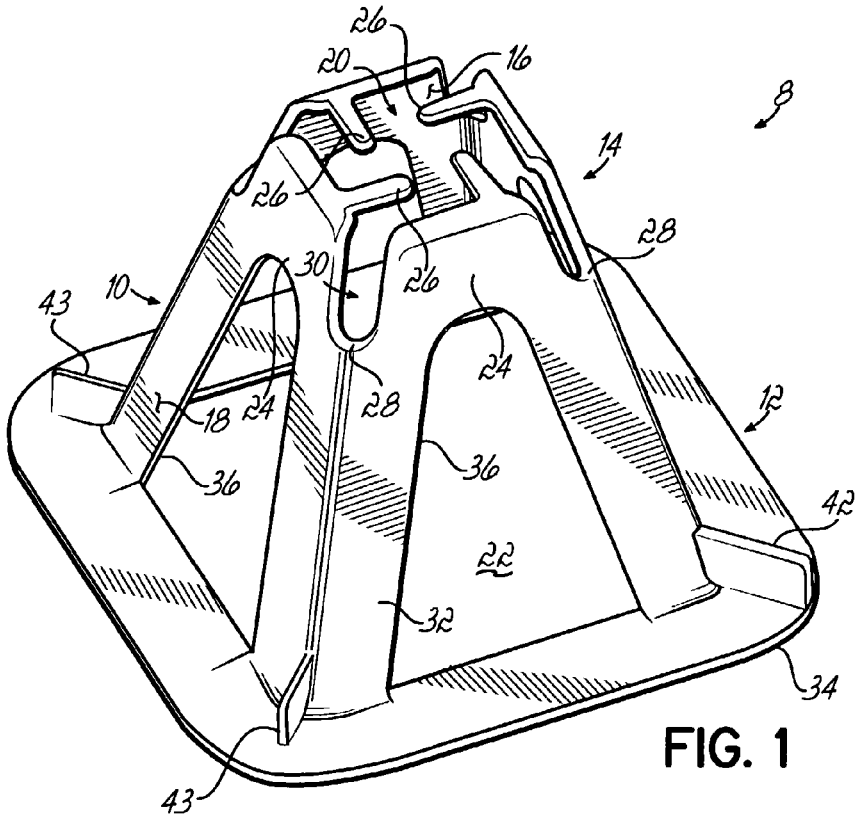
FIG. 1 is a perspective view of one embodiment of the chair of the present invention.

Referring now to FIG. 1, a perspective view is shown of one embodiment of the wire mesh chair 8 of the present invention having a hollow body 10 including a base 12, a receiving area 14, an inner surface 16, and an outer surface 18. There is an upper opening 20 defined by the receiving area 14 and a lower opening 22 defined by the base 12. Receiving area 14 has a plurality of walls 24 with inwardly facing detents 26. Walls 24 project upwardly between generally rounded notches 28. Between the notches 28 are passageways 30 defined by the walls 24. The lower base 12 has a plurality of separate support legs 32 extending downwardly from the receiving area 14. A foot member 34 extends horizontally outwardly from legs 32. Adjacent support legs 32 define holes or apertures 36, which allow poured concrete to fluidly pass through the wire mesh chair 8. At the base of the support legs are projections, one long projection 42 and three short projections 43.

The chair of FIG. 1 is preferably generally square in cross-section having rounded corners and is constructed of a single piece of resilient polymeric material. However, alternative embodiments of the chair may have a polygonal, elliptical, oval, or hybrid cross-section. Regardless of the cross-sectional configuration of the chair 8, the inner surface 16 is complementary to the outer surface 18, and the body 10 has multiple straight sides and is generally tapered, with the lower opening 22 being larger than the upper opening 20, thereby allowing multiple chairs to be stacked within one another. The tapered shape of the chair also requires that the upper portion of the body 10, including the receiving area 14, is generally relatively narrow as compared to the lower portion, which includes the wider base 12.

The base 12 includes projections 42 and 43. In the exemplary embodiment shown, the projections 42, 43 are located adjacent legs 32 at generally diagonally opposite positions of foot member 12. In these locations, projections 42, 43 help to strengthen the foot member 34, and thereby provide added strength with minimal increase in materials. However, it will be recognized that the projections may alternatively be formed in other locations on the foot member 34. Projection 42 is longer than projections 43, such that it extends from the base of its support leg 32 to the periphery of its foot member 34. Having one long projection 42 also provides directionality to the chairs, which are preferably square in cross-section. In this way, the chairs can be stacked with the long projection 42 of one chair directly over the long projection 42 of another chair, such that a user can recognize a specific corner of the chair.

Figure 2:
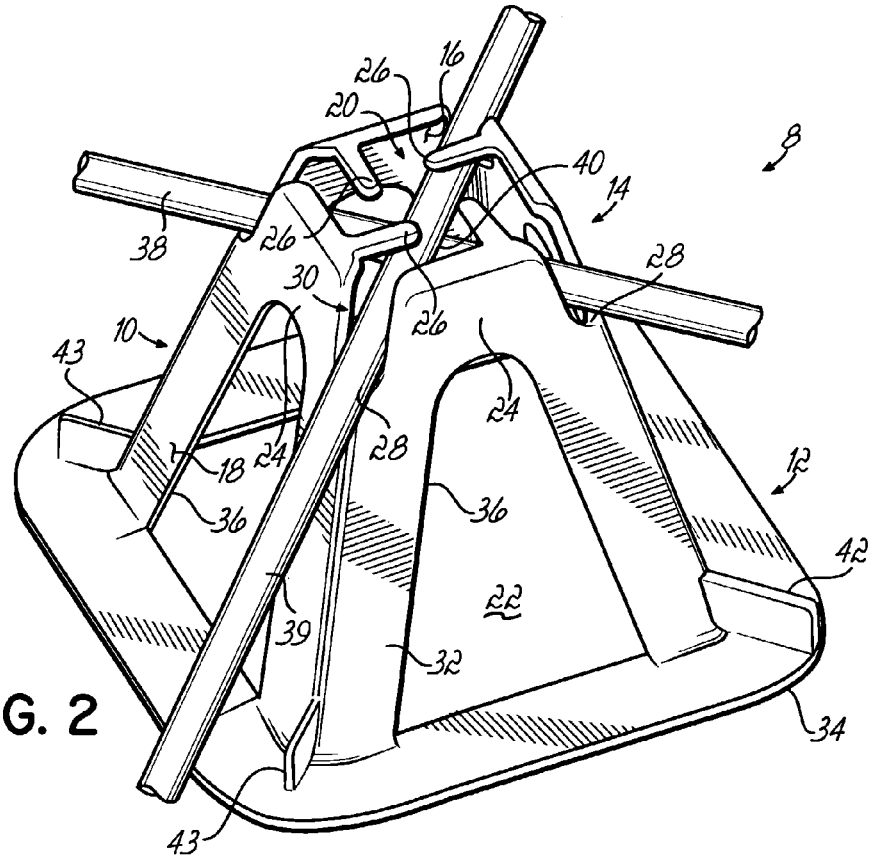
FIG. 2 is a perspective view of the chair of FIG. 1 in which a wire mesh structure has been placed in the receiving area.

FIG. 2 shows wire mesh strands 38 and 39 being supported by the chair 8 of FIG. 1. Wire mesh strands 38 and 39 intersect and form a junction 40 with one another within the middle part receiving area 14, and this junction is preferably a welded wire mesh junction. Strands 38 and 39 are fixed or retained within the chair by a cooperative relationship between the notches 28, walls 24, and detents 26. Detents 26 are preferably resilient to allow the wire mesh strands to pass easily into the passageways 30. Detents 26 project or extend horizontally inwardly from the walls 24 and are designed to fixedly retain the wire mesh strands 38 and 39 in position within the passageways 30. The detents 26 are preferably placed in an off-centered position as they project from the walls 24, and most preferably project from the upper right side of the walls 24, as shown in FIG. 2. Further, each detent can be sloped in a direction toward the base to facilitate insertion of strands into the receiving area.

As a non-limiting example of how the wire mesh is placed within the chair 8, the junction 40 of the wire mesh strands 38, 39 is initially positioned over the upper opening 20 and then snapped or pushed over the off-centered detents 26. The strands 38, 39 then pass into the passageways 30 between the walls 24, and the lower strand 38 rests in the notches 28. Notches 28 are curved in a semicircular fashion to receive and support the wire mesh. The chair 8 thus supports the adjoined strands 38 and 39 within the passageways 30 at four points an equal distance from the junction 40 of the strands.

As can be seen in FIG. 2, wire mesh strand 38 sits below wire mesh strand 39 within notches 28. Each wire mesh strand 38, 39 fits within a passageway 30 defined by the walls 24. Detents 26 project or extend horizontally inwardly from walls 24 to secure or otherwise fixedly retain top wire mesh strand 39 in proper position, while bottom wire mesh strand 38 sits within notches 28 and is fixedly retained in this position by walls 24, as well as by the junction 40 with wire mesh strand 39.

FIG. 2 further illustrates the tapered shape of the chair 8. The upper portion of body 10 is narrow at the upper opening 20 between the detents 26. Body 10 gradually widens from the walls 24 down to the foot member 34. Lower opening 22 is much larger than the upper opening 20, with the upper opening 20 being the geographical center of the wire mesh chair 8, and each support leg 32 proceeding in a straight line from beneath a notch 28 to a foot member 34. The disc-like foot member 34 extends horizontally outwardly from the support legs 32, forming a wide base adapted to support the weight of the chair 8 as well as the wire mesh structure. The wide base feature improves the stability of the chair, preventing it from tilting and falling. The wide base keeps the chair straight up during concrete pouring when the liquid concrete will be coming in from the sides of the chair. Tilting and falling has been observed in chairs with smaller, narrower bases, as the concrete, coming in from the sides of the chairs, pushes and lifts the chairs from the ground. Apertures 36 between the support legs 32 allow fluid concrete to pass through the body 10 beneath the level of wire mesh strands 38, 39. In an alternative embodiment, there is no interconnection of the support legs, such that there are as many foot members as there are legs. In this alternative embodiment, although the foot members do not interconnect the legs in a disc-like fashion, they still allow body to be free-standing while supporting a substantial weight on soft grade surfaces. This embodiment is ideal for placement of the chair on a soft grade platform or surface where there is some unevenness of the surface.

Figure 3:
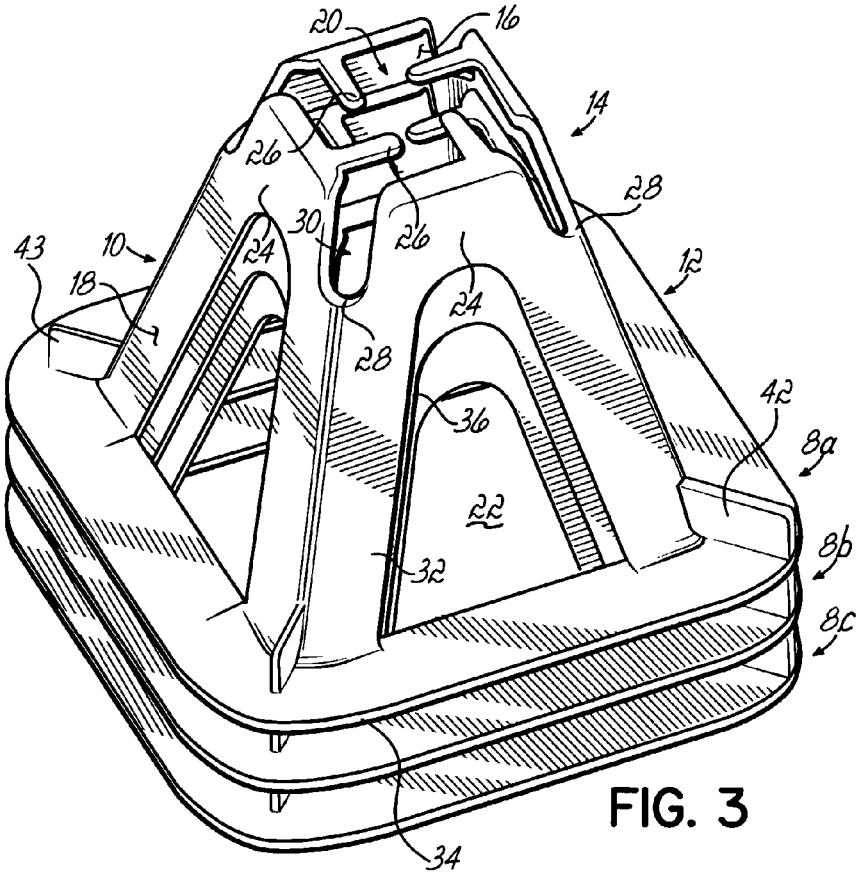
FIG. 3 is a perspective view of a plurality of chairs stacked within one another in accordance with one aspect of the invention.

The large openings provided by the apertures 36 maximize the free flow of concrete into and around chair 8. Apertures 36 are shown in FIGS. 1 through 3 as being generally triangular in shape and curved at the apex. One of skill in the art will recognize, however, that a variety of shapes, sizes, and numbers of apertures can be used. Support legs 32 are generally of sufficient width and strength to support a substantial load, such as the force of the wire mesh strands 38 and 39 as well as the force applied by construction workers who may step or walk on the wire mesh structure during the construction process.

In the embodiment of the chair 8 shown in FIGS. 1 through 3, the foot member 34 is manufactured as a singular, flattened, disc-like platform that interconnects the legs 32, forming a solid band of material. around lower opening 22. Foot member 34 allows the base 12 to rest on a flat, planar support surface, including loose or pliant surfaces such as dirt, sand, or the like, without sinking under the weight of the wire mesh strands. In FIG. 2, the detents 26 are shown above the wire mesh strands 38 and 39, and each detent 26 projects right of the center of its corresponding wall 24. In this manner, each detent 26 serves to substantially cover the passageway 30 to its right, thereby preventing the strand of wire mesh within that passageway from dislodging. Wire mesh strand 38 rests within notches 28, and wire mesh strand 39 rests on top of strand 38, within passageways 30, and is secured above by the detents 26.

As illustrated in FIG. 3, a plurality of chairs can be stacked together, one inside the other, for packaging, storage, shipment and handling at the job site. The combination of the tapered, generally funnel-like shape of the body 10, along with the complementary surfaces 16, 18, allows the upper receiving area 14 of chair 8*b* to be inserted within the lower opening 22 of chair 8*a*, such that the outer surface 18 of chair 8*b* slidably engages the inner surface 16 of chair 8*a*. The distance that one chair is able to fit inside a second chair is dependant upon the degree of slope assumed by the surfaces 16 and 18 as the body 10 progresses from the upper opening 20 to the lower opening 22. That is, the smaller the upper opening 20 is relative to the lower opening 22, the greater the slope will be of the surfaces 16 and 18. Preferably, this slope is sufficient to allow a substantial portion of the first chair to fit within the second chair, such that a great number of chairs can be stacked in a minimal amount of space without the stack becoming too tall or burdensome. The stacking ability of the chairs allows a worker to carry a stack of chairs with him in one hand when installing the chairs, which results in substantial savings in time by eliminating multiple trips to and from the supply of chairs at the job site.

As shown in FIG. 3, chairs 8*a* and 8*b* further include a plurality of projections 42, 43 extending upwardly from the foot member 34 in a direction generally toward the receiving portion 14. The projections 42, 43 help to maintain a separation between the chairs when they are stacked together, so that individual chairs can be readily separated when desired. Projections 42 and 43 also permit the chairs to be stacked together after being formed and while the chairs are still hot, whereby the separation prevents confronting inner and outer surfaces 16, 18 from sticking together. The projections may extend across the entire width of foot member 34 as depicted by projection 42, or may extend only part way across the width of foot member 34 as illustrated by projection 43, thereby providing some directionality to the chairs.

Figure 4:
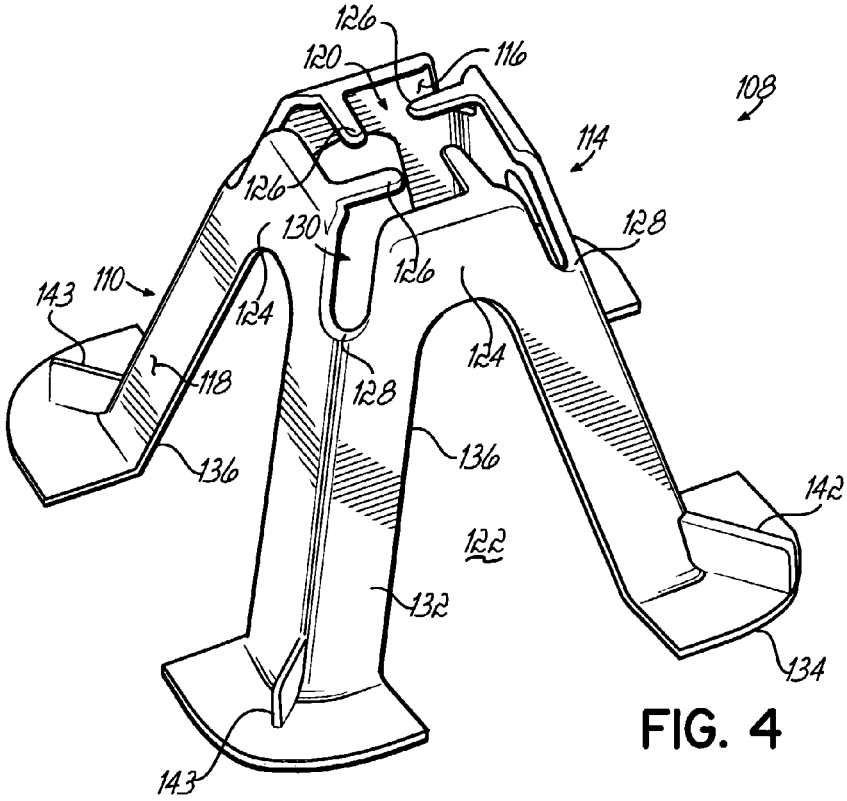
FIG. 4 is a perspective view of another embodiment of the chair of the present invention having individual foot members for each support leg.

FIG. 4 is an illustration of another exemplary chair 108 of the present invention wherein each of the support legs 132 has a foot member 134 extending radially outwardly therefrom in a horizontal plane. In this embodiment, there is no interconnection of the support legs 132, such that there are as many foot members 134 as there are legs 132. Although the foot members 134 do not interconnect the support legs 132 in a disc-like fashion, they still allow body 110 to be free-standing while supporting a substantial weight on soft grade surfaces. This embodiment is ideal for placement of the chair 108 on a soft grade platform or surface where there is some unevenness of the surface.

The receiving area 114 of the chair 108 in FIG. 4, like the chair 8 of FIGS. 1 through 3, includes a receiving area 114 having a plurality of walls 124 with inwardly facing detents 126. Walls 124 project upwardly between generally rounded notches 128. Between the notches 128 are passageways 130 defined by the walls 124. Adjacent support legs 132 define holes or apertures 136, which allow poured concrete to fluidly pass therethrough. At the base of the support legs are projections, one long projection 142 and three short projections 143. The inner surface 116 is substantially complementary to the outer surface 118, and the body 110 has multiple straight sides and is generally tapered, with the lower opening 122 being larger than the upper opening 120, thereby allowing multiple chairs to be stacked within one another. The tapered shape of the chair also requires that the upper portion of the body 110, including the receiving area 114, is generally relatively narrow as compared to the lower portion.

Figure 5:
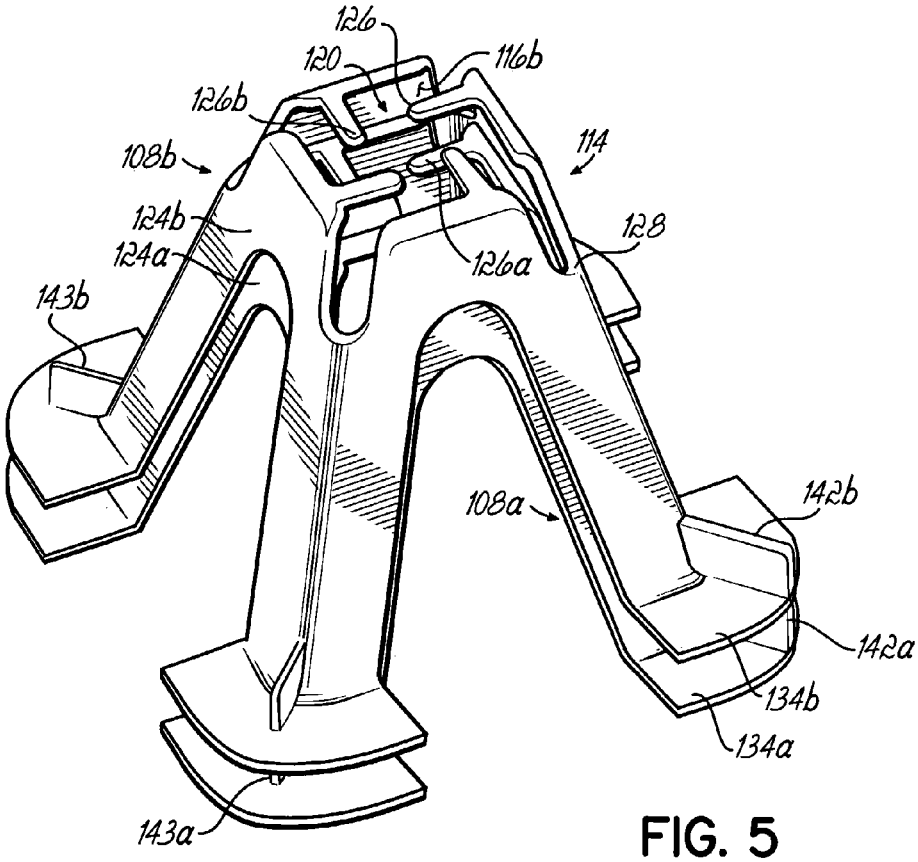
FIG. 5 is a perspective view of a plurality of chairs of FIG. 4, arranged in a stack.

FIG. 5 illustrates how a plurality of chairs 108 may be arranged in a stack, with one chair 108*a* nested within another 108*b* as described above with respect to FIG. 3. Specifically, the respective inner and outer surfaces 116, 118 of the chairs 108*a*, 108*b* are placed in confronting relationship and projections 142, 143 help to maintain a separation between the stacked chairs 108*a*, 108*b* to facilitate separation when desired.

Figure 6:
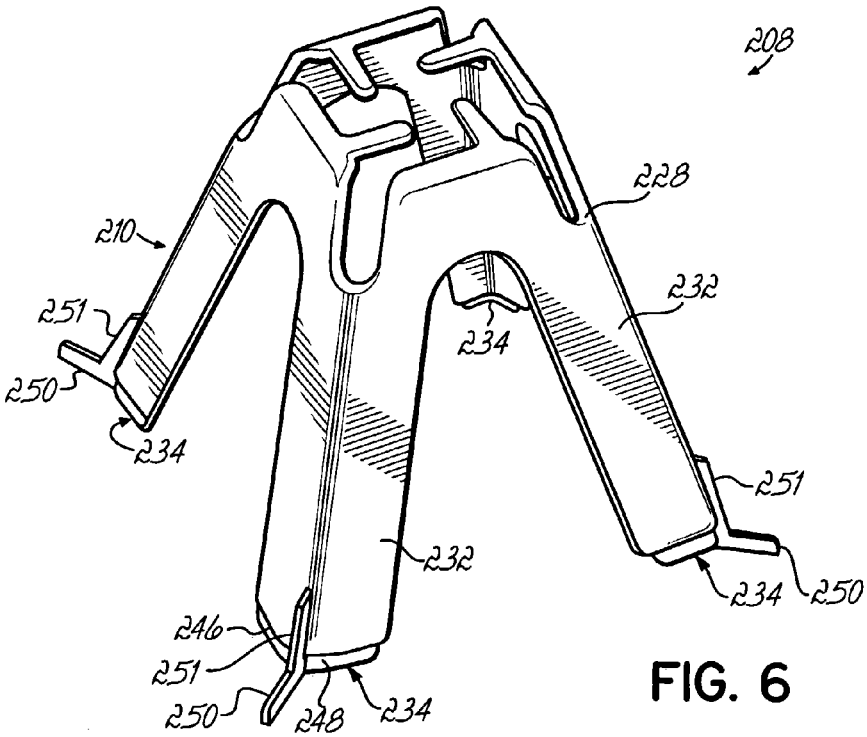
FIG. 6 is a perspective view of another embodiment of the chair of the present invention having individual foot members which make a small footprint.

FIG. 6 is an illustration of another exemplary chair 208 of the present invention wherein a foot member 234 extends downwardly in a vertical plane from the lower surface of each of the support legs 232. Like the chair in FIG. 4, there are as many foot members 234 as there are legs 232. Each foot member 234 includes a first portion 246 and a second portion 248 which are generally aligned with the legs 232 and joined at about a 90 degree angle. Each foot member 234 is preferably about ¼ inch in height. Radially outwardly extending from the intersection of the first portion 246 and second portion 248 is a support member 250. The foot members 234 also have projections 251 provided adjacent the support members 250 and extending upwardly along support legs 232. Advantageously, the foot members 234 have a minimal footprint which assists in hiding the chair body 210 from view and that improves the aesthetics of the structure, especially when used in tilt-up panels. It will be appreciated, however, that the foot members 234 can have any desired configuration and that the chair body 210 does not require the foot members.

Figure 7:
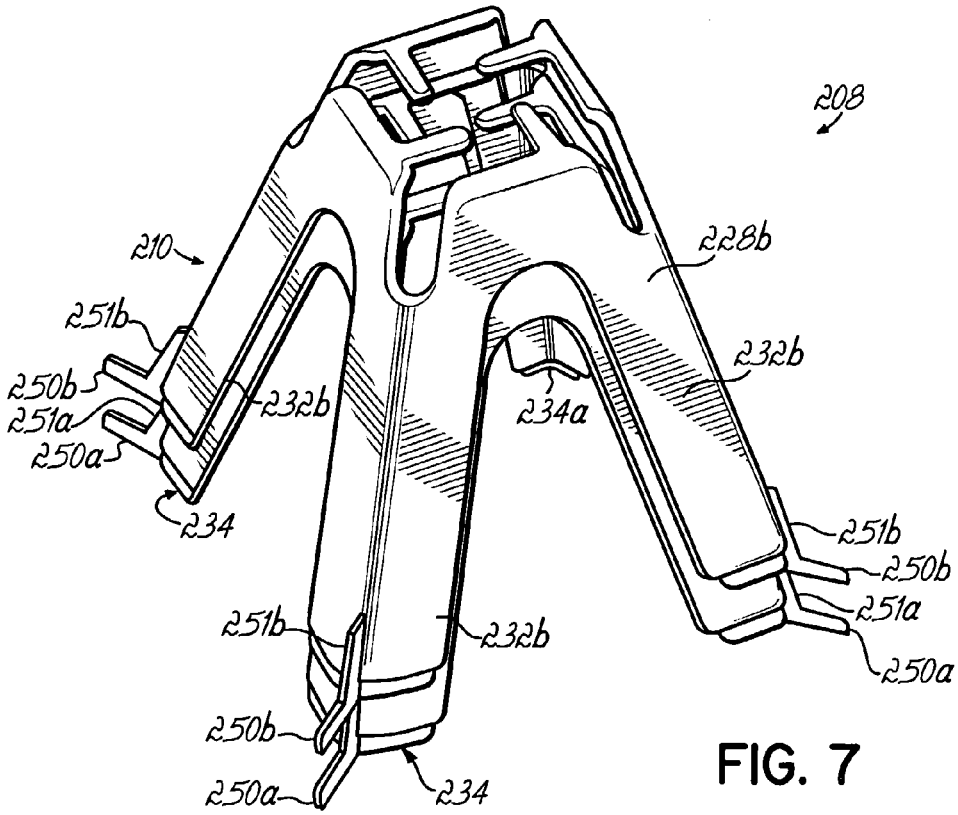
FIG. 7 is a perspective view of a plurality of chairs of FIG. 6, illustrating the chairs in a stacked configuration.

FIG. 7 illustrates a plurality of chairs 208 of FIG. 6 arranged in a stack, in a manner similar to chairs 8, 108 of FIGS. 3 and 5. Advantageously, upwardly extending projections 251 help to maintain separation between the stacked chairs 208, as described above with respect to chairs 8, 108.

Figure 8:
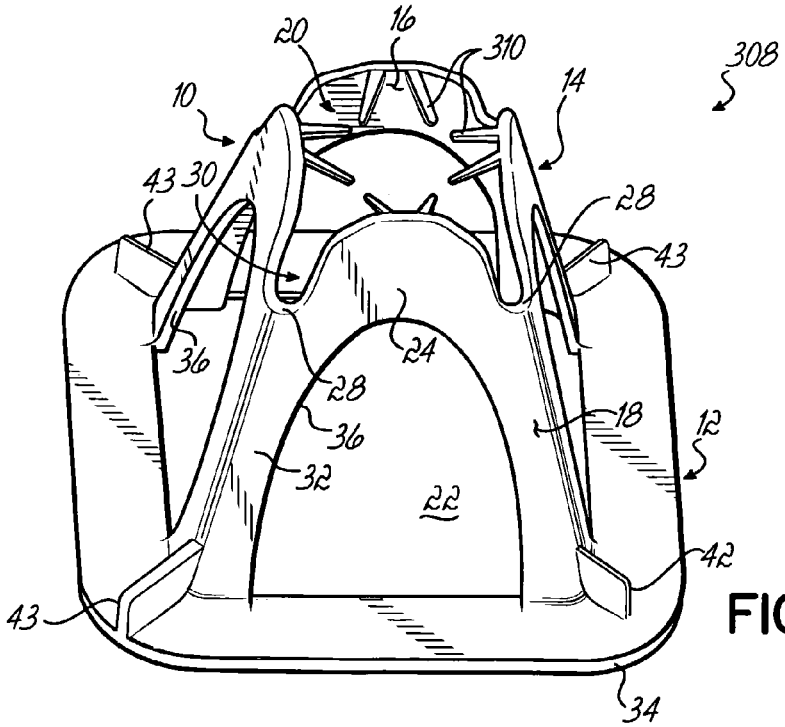
FIG. 8 is a perspective view of yet another embodiment of a chair according to the present invention.

Referring now to FIG. 8, there is shown another exemplary chair 308 of the present invention. Chair 308 is similar to the exemplary chair 8 of FIGS. 1–3, with the exception that chair 308 has pairs of centered, inwardly and downwardly extending detents 310, instead of off-center detents 26, to retain wire mesh strands within passageways 30. Other features of chair 308 are numbered to correspond to similar features depicted in FIG. 1. Advantageously, detents 308 are configured to facilitate insertion of wire mesh strands into passageways 30.

It should be noted that the chairs depicted in FIGS. 4–8 of the drawings are configured, as are the chairs and FIGS. 1–3 of the drawings, to permit stacking of the chairs with all of the advantages of that characteristic of the chair noted above in connection with the prior embodiments. Thus, as seen more clearly in FIGS. 5 and 7 of the drawings, multiple chairs may be stacked one within the other, with consequent savings in packaging, storage and shipping, as well as convenience at the job site. Thus, a workman may pick up a number of stacked chairs in one arm and walk across the job site installing individual chairs at pre-determined locations, and thus saving multiple trips between the installation points and the location where the chairs are off-loaded from a delivery truck.

The foot members illustrated in FIGS. 1–8 are desirably sized to support the wire mesh chair on a variety of different surfaces. For example, the foot members may sink into or be embedded into soft surfaces such as dirt or sand to increase the stability of the chair. The disc-like foot members 34, 134 of the chairs in FIGS. 1, 4 and 8, and the support member 250 of the chair in FIG. 6, advantageously prevent the chair from sinking into soft soil, and that allows the chair to be positioned at the desired height.

The chair of the present invention is preferably constructed from a resilient polymeric material and, more specifically, is constructed of a plastic or resin material. Further, the chair is most preferably made of polypropylene and is one-piece injection molded. One of ordinary skill in the art will recognize that other materials exhibiting similar characteristics of being lightweight, strong and resilient can be used, such as polyethylene, a combination of polypropylene and polyethylene, and other known materials.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A chair for supporting wire mesh, the wire mesh comprised of wire strands joined in intersecting relationships creating a multiplicity of junctions, the chair comprising:

a body including an upper receiving area and a lower base, the receiving area including walls projecting upwardly from the base and adapted to secure the wire strands engaged thereby, the base adapted to rest on a planar support surface, the body having an inner surface and an outer surface, the surfaces being substantially complementary to each other to allow a plurality of chairs to be stacked within one another for storage and shipment, the receiving area further including notches to receive and support the strands, the walls defining passageways above the notches, and the receiving area further including detents projecting inwardly from the walls, the detents adapted to fixedly retain the strands within the passageways; and wherein the detents are offset from central portions of the walls to thereby cooperate with the passageways to retain the strands.

2. The chair of claim 1, wherein at least a portion of each detent is sloped in a direction toward the base to facilitate insertion of strands into the receiving area.

3. The chair of claim 1, the base including a plurality of support legs extending downwardly from the receiving area and defining a plurality of apertures, the apertures operable to allow poured concrete to pass fluidly through the body.

4. The chair of claim 3, the base further including at least one foot member extending from a lower surface of at least one of the plurality of support legs.

5. The chair of claim 4, wherein the at least one foot member is a single foot member consisting of a continuous band of material extending outwardly in a horizontal plane, the plurality of support legs being connected by the single foot member.

6. The chair of claim 5, wherein the single foot member further includes at least one projection extending upwardly therefrom in a vertical plane.

7. The chair of claim 6, wherein one of the at least one projection is located at each of the plurality of support legs.

8. The chair of claim 4, wherein one of the at least one foot member extends outwardly in a horizontal plane from each of the plurality of support legs.

9. The chair of claim 8, wherein the at least one foot member further includes at least one projection extending upwardly therefrom in a vertical plane.

10. The chair of claim 8, wherein the chair is made of polypropylene and is one-piece injection molded.

11. The chair of claim 1, wherein the receiving area and the base are integrally formed together of a resilient polymeric material.

12. A chair for supporting wire mesh, the wire mesh comprised of wire strands joined in intersecting relationships creating a multiplicity of junctions, the chair comprising:

a body including an upper receiving area and a lower base, the receiving area including walls projecting upwardly from the base and adapted to secure the wire strands engaged thereby, the base adapted to rest on a planar support surface, the body having an inner surface and an outer surface, the surfaces being substantially complementary to each other to allow a plurality of chairs to be stacked within one another for storage and shipment, the base including a plurality of support legs extending downwardly from the receiving area and defining a plurality of apertures, the apertures operable to allow poured concrete to pass fluidly through the body, the base further including at least one foot member extending from a lower surface of at least one of the plurality of support legs, wherein the at least one foot member is a single foot member consisting of a continuous band of material extending outwardly in a horizontal plane, the plurality of support legs being connected by the single foot member, wherein the single foot member further includes at least one projection extending upwardly therefrom in a vertical plane, wherein one of the at least one projection is located at each of the plurality of support legs, and wherein one of the at least one projection extends across the entire width of the single foot member.

13. A chair for supporting wire mesh, the wire mesh comprised of wire strands joined in intersecting relationships creating a multiplicity of junctions, the chair comprising:

a body including an upper receiving area and a lower base, the receiving area including walls projecting upwardly from the base and adapted to secure the wire strands engaged thereby, the base adapted to rest on a planar support surface, the body having an inner surface and an outer surface, the surfaces being substantially complementary to each other to allow a plurality of chairs to be stacked within one another for storage and shipment, the base including a plurality of support legs extending downwardly from the receiving area and defining a plurality of apertures, the apertures operable to allow poured concrete to pass fluidly through the body, the base further including a least one foot member extending from a lower surface of at least one of the plurality of support legs, wherein one of the at least one foot member extends outwardly in a horizontal plane from each of the plurality of support legs, wherein the at least one foot member further includes at least one projection extending upwardly therefrom in a vertical plane, and wherein one of the at least one projection extends across the entire width of one of the at least one foot member.

14. A chair for supporting wire mesh, the wire mesh formed of strands of wire joined at a plurality of junctions in intersecting relationships, the chair comprising:

a hollow body including an inner surface, an outer surface, a receiving area, and a base, the base defining a lower opening and adapted to rest on a planar support surface, the receiving area defining an upper opening and adapted to receive and retain at least one junction of the mesh, the receiving area including a plurality of notches, walls, and detents, the notches configured to receive the strands, the walls projecting upwardly between the notches and defining passageways configured to direct the strands into the notches, the detents configured to extend inwardly from the walls and operable to fixedly retain the strands within the receiving area, the base including a plurality of support legs defining a plurality of apertures therebetween, the apertures operable to allow poured concrete to pass fluidly through the chair;

wherein the body is generally funnel-shaped with the lower opening being larger than the upper opening, and the inner and outer surfaces are substantially complementary to each other to allow a plurality of chairs to be stacked within each other for storage and shipment; and wherein the detents are offset from central portions of the walls to thereby cooperate with the passageways to retain the strands.

15. The chair of claim 14, wherein at least a portion of each detent is sloped in a direction toward the base to facilitate insertion of strands into the receiving area.

16. The chair of claim 14, wherein the detents are positioned at an upper right portion of the walls, thereby covering the right adjacent passageway.

17. The chair of claim 14, the base further including at least one foot member extending from the plurality of support legs.

18. The chair of claim 17, further comprising a plurality of projections disposed on the at least one foot member and extending in a direction generally toward the receiving area.

19. The chair of claim 17, wherein the at least one foot member is a single continuous band connecting the plurality of support legs, the at least one foot member extending outwardly in a horizontal plane from the plurality of support legs.

20. The chair of claim 17, wherein one of the at least one foot member extends outwardly in a horizontal plane from each of the plurality of support legs.

21. A chair for supporting wire mesh, the wire mesh formed of strands of wire joined at a plurality of junctions in intersecting relationships, the chair comprising:

a hollow body including an inner surface, an outer surface, a receiving area, and a base, the base defining a lower opening and adapted to rest on a planar support surface, the receiving area defining an upper opening and adapted to receive and retain at least one junction of the mesh, the receiving area including a plurality of notches, walls, and detents, the notches configured to receive the strands, the walls projecting upwardly between the notches and defining passageways configured to direct the strands into the notches, the detents configured to extend inwardly from the walls and operable to fixedly retain the strands within the receiving area, the base including a plurality of support legs defining a plurality of apertures therebetween, the apertures operable to allow poured concrete to pass fluidly through the chair, wherein the body is generally funnel-shaped with the lower opening being larger than the upper opening, and the inner and outer surfaces are substantially complementary to each other to allow a plurality of chairs to be stacked within each other for storage and shipment, the base further including at least one foot member extending from the plurality of support legs, the chair further comprising a plurality of projections disposed on the at least one foot member and extending in a direction generally toward the receiving area, and wherein at least one of the projections extends across the entire width of at least one of the at least one foot member.

* * * * *

UNITED STATES PATENT AND TRADEMARK OFFICE

CERTIFICATE OF CORRECTION

PATENT NO. : 7,028,443 B2
APPLICATION NO. : 10/614715
DATED : April 18, 2006
INVENTOR(S) : Clifford D. Bennett et al.

It is certified that error appears in the above-identified patent and that said Letters Patent is hereby corrected as shown below:

Claims:

Col. 9, Line 40 – Change "a" before "least" to -- at --.

Signed and Sealed this

First Day of August, 2006

JON W. DUDAS
*Director of the United States Patent and Trademark Office*